United States Patent [19]

Bernet

[11] Patent Number: 4,698,992

[45] Date of Patent: Oct. 13, 1987

[54] WOBBLE-DIE FORGING MACHINE

[75] Inventor: Alois Bernet, Jona, Switzerland

[73] Assignee: Heinrich Schmid Maschinen-und Werkzeugbau AG, Rapperswil, Switzerland

[21] Appl. No.: 715,192

[22] Filed: Mar. 22, 1985

[30] Foreign Application Priority Data

Apr. 21, 1984 [CH] Switzerland ..... 1968/84

[51] Int. Cl.[4] ..... B21J 9/18

[52] U.S. Cl. ..... 72/67; 72/406

[58] Field of Search ..... 72/67, 112, 115, 125, 72/406, 78; 74/86, 665 A, 836; 464/102, 104

[56] References Cited

U.S. PATENT DOCUMENTS

| | | | |
|---|---|---|---|
| 2,756,573 | 7/1956 | Colby et al. | 464/104 |
| 3,735,617 | 5/1973 | Bretschneider | 72/78 |
| 4,121,438 | 10/1978 | McCullough | 464/102 |

FOREIGN PATENT DOCUMENTS

| | | | |
|---|---|---|---|
| 1079940 | 8/1967 | United Kingdom | 72/78 |
| 721187 | 3/1980 | U.S.S.R. | 72/115 |

OTHER PUBLICATIONS

Metallurgia and Metal Forming, Jun. 1977, "Orbital Forging", by John R. Maicki.

*Primary Examiner*—Lowell A. Larson

*Attorney, Agent, or Firm*—Karl F. Ross; Herbert Dubno

[57] ABSTRACT

In the upper part of the wobble-die forging machine, a guide spigot of the bell-shaped upper die mounting engages, for the production of circular rocking movements, by way of self-aligning roller bearing means into a first eccentric sleeve, which is rotationally guided by way of further bearing means in a second eccentric sleeve supported by way of bearing means at the machine frame. In this case, the first eccentric sleeve stands in driving connection by way of coupling means with the shaft of a first motor and the second eccentric sleeve stands in driving connection by way of cogwheel means with the shaft of a second motor, wherein the one and/or the other of the motors is or are regulable in respect of rotational speed and rotational direction through a common control equipment. Thereby, an arrangement is attained, the build-up and thereby the expenditure of which is substantially smaller compared with the state of the art and which requires less constructional volume and permits a desired regulation of rotational speed and rotational direction of the eccentric sleeves.

3 Claims, 2 Drawing Figures

WOBBLE-DIE FORGING MACHINE

FIELD OF THE INVENTION

My present invention relates to a wobble-die forging machine, the lower die of which is supported by the machine frame and displaceable upward against the upper die by a hydraulic piston-cylinder pressure system and the upper die of which is built into a bell-shaped mounting supported in a spherical pan at the machine frame. A guide formation projects vertically upward from the bell-shaped mounting and, for the generation of wobble movements at the upper die, engages through self-aligning roller bearing in a first eccentric sleeve which is drivable by a motor and rotationally guided in a second eccentric sleeve which is supported at the machine frame and drivable by a motor.

BACKGROUND OF THE INVENTION

Compared with flow-pressing, in which the deformation force acts simultaneously on the entire workpiece surface, in the case of wobble-die forging, force is as is known exerted only on a partial surface, so that only a small amount of friction can arise and the material flows in a radial direction without great resistance. For this, the blank is deformed between upper die and a lower die with circularly rocking movement of the upper die, wherein the deformation force is concentrated on only a partial surface of the workpiece. The deformation is effected by movement of the pressure zone over the entire workpiece surface.

Due to the smaller contact area and the more favorable friction conditions, the deformation force in wobble-die forging machines is thus substantially smaller than in the case of conventional flow-pressing.

Resulting from this are the advantages of appreciably smaller machines, less die loading and smaller noise development. In addition, products significantly larger in shape can be attained in one operating step by the wobble-die forging machines by comparison with the multistage dies necessary for large products in conventional flow presses, with all their costs and setting-up times.

Thus wobble-die forging has become more significant, particularly since the technologies required for it have in recent times been elaborated to the point that functionally capable machines for the purpose are now available.

However, some functional means of the existing overall conceptions require further improvements.

Thus, for example, the construction and drive of the eccentric sleeves, which engage the guide spigot of the bell-shaped upper die mounting, for producing different kinds of movement at the upper die, have problems.

Although the means hitherto used for this already permit a circular movement of the upper die for circularly symmetrical deformations, a spiral movement for radial and axial deformation, a rectilinear movement for deformations in two directions as well as a multi-lobe curvilinear movement for deformations of parts with pronounced surface structure, these means are very expensive, cannot be fully controlled and are very large size.

The reason for this is inter alia the co-axial guidance of drive axles, of which each is rotationally connected with a respective one of the eccentric sleeves. Both axles in that case end in a gear rim, through which each eccentric sleeve is in driving connection with a regulable direct current motor and through which on the other hand both of the eccentric sleeves are operatively connected through an expensive transmission gear.

OBJECT OF THE INVENTION

The object of my present invention is to provide the wobble-die forging machine of the afore-named kind with drive means for the eccentric sleeves, whose construction and cost are significantly smaller by comparison with prior drives and which can be of smaller size and permit the desired regulation of rotational speed and rotational direction of the eccentric sleeves.

SUMMARY OF THE INVENTION

I realize this object, in accordance with my present invention, by providing the first eccentric sleeve so that it is in driving connection through coupling means with the shaft of a first motor and so that the second eccentric sleeve is in driving connection through cogwheel means with the shaft of a second motor, the one and/or the other of the motors being regulable as to rotational speed and rotational direction through common control equipment.

In that case, an advantageous refinement of the measures according to the invention then exists, when the shaft of the first motor extends along the central axis of the machine and the shaft of the second motor extends parallel to the first in the upper region of the upper part of the machine and at a spacing therefrom corresponding to the pitch circle radii of the cogwheel means between this shaft and the second eccentric sleeve.

It is then advantageous that the second eccentric sleeve carry an outer gear rim which stands in engagement with a cogwheel at the free end of the shaft of the second motor and, furthermore, that the free end of the shaft of the first motor carry a horizontally extending coupling plate. The first, inner eccentric sleeve can carry an upper end flange and the coupling plate and end flange, slide one on the other and are displaceable one relative to the other, their entraining connection being produced by a slide block which projects from the end flange and engages in a slide groove formed at the end face of the coupling plate.

Further advantages then result, when both the motors are flanged on at the upper end surface of the upper part of the machine.

Through these features according to the invention, a wobble-die forging machine of the afore-described kind is provided, which meets all demands as to the structure and the drive of the eccentric sleeves engaging at the guide spigot of the bell-shaped upper die mounting. As can easily be seen, the individual drive technique according to the invention permits each eccentric sleeve, apart from a substantially improved possibility of the regulation of rotational speed and rotational direction at the eccentric sleeves and thereby an increase in the possibilities of variation of the wobble movements producible at the upper die, to have a comparatively simple contruction of the means with substantially smaller overall height of the machine, which thus leads to a far better wobble-die forging machine.

BRIEF DESCRIPTION OF THE DRAWING

The above and other features of my invention will now be described in detail with reference to the accompanying drawing in which.

SPECIFIC DESCRIPTION

Figure 1:
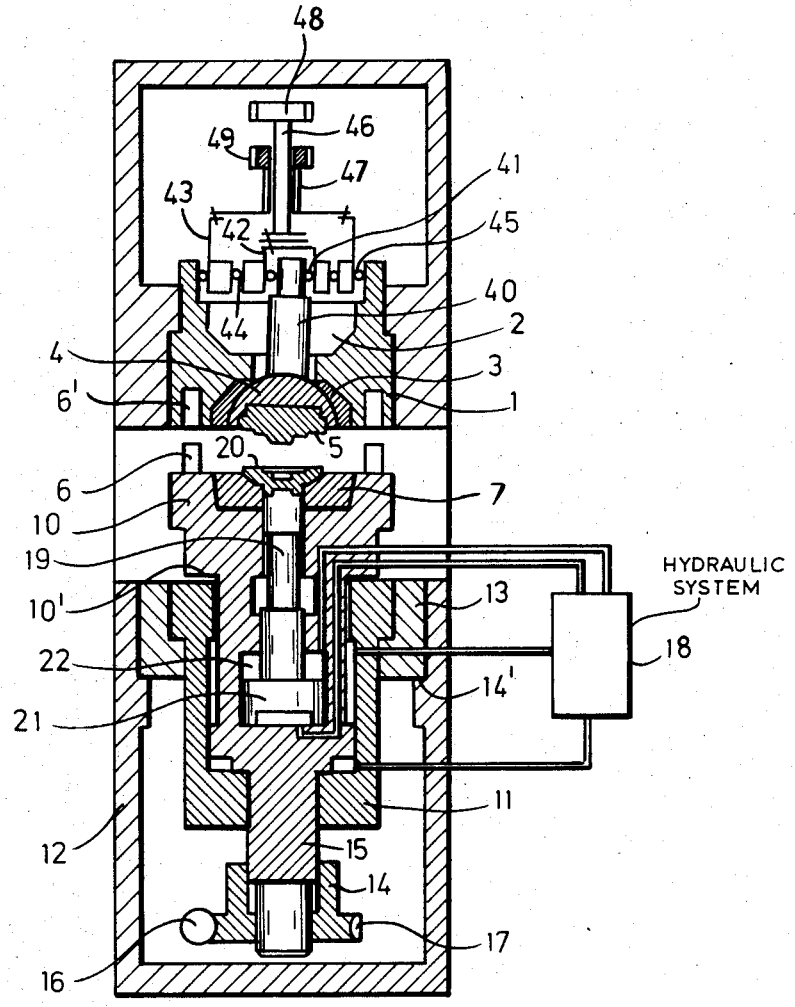
FIG. 1 is a schematic sectional illustration of a wobble-die forging machine.

The wobble-die forging machine which is illustrated in FIG. 1 and shown in an open position after a deformation process, comprises a lower die 7 and an upper die 5, between which a workpiece 20 was deformed by a circularly rocking movement of the upper die 5.

For this, the lower die 7 bears by way of a hydraulic piston-cylinder pressure system 10 and 11 against the machine frame 12 and is displaceable vertically upward against the upper die 5. The lower die 7 is exchangeably inserted in the end face of the piston 10 of the pressure system, the cylinder 11 of which is surrounded in its upper rim region by a collar 13 which firmly sits on an annular shoulder 14' of the machine frame 12. The stroke of the piston 10 in the cylinder 11 is limited on the one hand downwardly by an annular shoulder 10' of the piston 10, which co-operates with the upper end face of the cylinder 11, and on the other hand upwardly by an abutment nut 14 which co-operates with the lower end face of the cylinder 11. For this, the piston 10 extends by a lower spindle 15 in fluid-tight manner through the base of the cylinder 11, on which spindle 15 the abutment nut 14 is threaded, to be axially displaceable. The axial displacement of the abutment nut 14 for a stroke change at the pressure piston 10 and thus setting of the workpiece height is effected through a spindle 16, which is actuatable by motor or manually and engages in a gear rim 17 at the outer circumference of the abutment nut 14.

For the generation of the pressing force, which is directed vertically upwards and can amount to some thousand kiloNewtons, by the pressure piston 10, the cylinder 11 of the piston-cylinder pressure system is connected to a hydraulic system 18, which preferably comprises an adjustable high pressure axial-piston pump for the generation of the pressing force and low-pressure and high-pressure pump means for a rapid setting of the pressure piston (not shown).

As FIG. 1 illustrates, arranged centrally within the pressure piston 10 is a vertically displaceable ejector 19, which can press the workpiece 20 after its production out of the lower die 7. For this, the ejector 19 in its lower part forms a piston 21, the cylinder chamber 22 of which is formed in the pressure piston 10 and connected through appropriate pressure lines to the hydraulic system 18.

Furthermore, the pressure piston 10 on its upper end face carries a plurality of guide columns 6, which project vertically upward and during the stroke of the pressure piston 10 enter into corresponding bores 6' at the lower end face of an upper part 1 of the machine, which part is firmly connected with the machine frame 12, and thus assure an optimum alignment of upper and lower dies 5 and 7.

At this upper part 1 of the wobble-die forging machine, a bell-shaped mounting 4, which exchangeably carries the upper die 5, is supported in a spheroidal pan 3 in such a manner that the circularly rocking movements described previously can be imparted to the upper die 5 through a corresponding displacement of the bell-shaped mounting in the spheroidal pan.

For this, a guide rod 40, which can execute a pendulating movement within a free space 2 of the upper part 1 of the machine, projects vertically upward and centrally from the bell-shaped mounting 4. For the generation of the aforementioned movements, the free end of the guide spigot 40 engages through suitable self-aligning roller bearing means 41 in a first eccentric sleeve 42, which is rotationally guided by way of bearing means 44 in a second eccentric sleeve 43 rotationally supported by way of bearing means 45 at the upper part 1 of the machine.

In order to be able to drive both these eccentric sleeves 42 and 43 in the initially described manner, these stand in driving connection here by way of co-axial driving axles 46 and 47 and gear rims 48 and 49 with motor and gear means not shown in FIG. 1 in greater detail.

Thus far, the construction and the function of a wobble-die forging machine can be treated as known so that further explanations are unnecessary.

Figure 2:
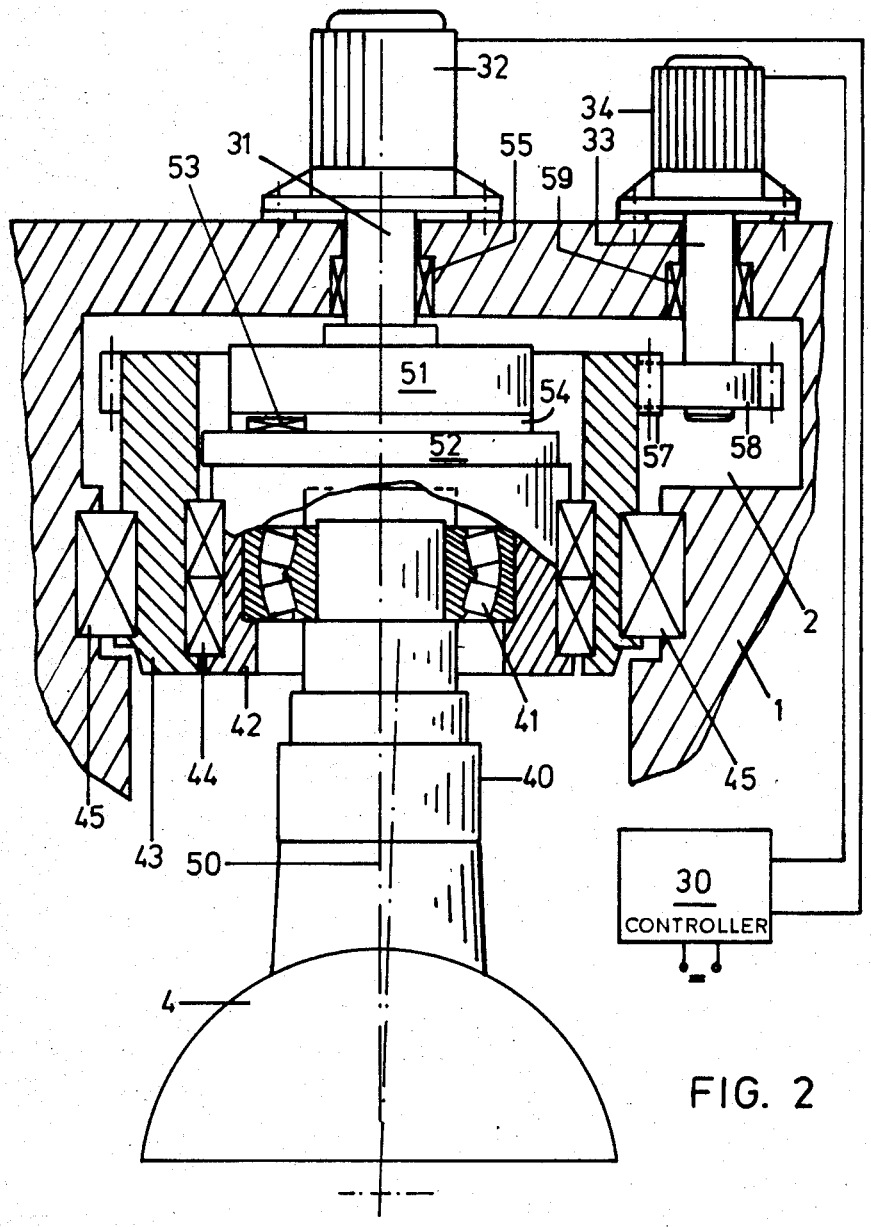
FIG. 2 is a partial vertical section of the wobble-die forging machine according to the invention drawn to greater scale.

In order now to provide such a wobble-die forging machine with drive means for the eccentric sleeves 42 and 43, which compared with the state of the art set substantially lower demands with respect to complicated structure and of lower cost of build-up and thereby in respect of expenditure, but at the same time, however, which also permit an unrestricted regulation of rotational speed and rotational direction of the eccentric sleeves, according to the invention the first eccentric sleeve 42 (FIG. 2) is connected by way of suitable coupling means 51 to 54 with the shaft 31 of a first motor 32 and the second eccentric sleeve 43 is connected by way of cogwheel means 57 and 58 with the shaft 33 of a second motor 34, as is illustrated more in detail in FIG. 2.

In this case, first, the shaft 31 of the first motor 32 extends along in the central axis 50 of the machine downwardly toward the first, inwardly disposed eccentric sleeve 42 through the upper region of the upper part 1 of the machine, supported by suitable bearing 55. The motor 32 is furthermore flanged to the upper end surface of the upper part 1 of the machine. The free end of the shaft 31 in that case carries a horizontally extending coupling plate 51, which slidingly and displaceably lies against an end flange 52 at the inner eccentric sleeve 42. The entraining connection between coupling plate 51 and inner eccentric sleeve 42 is in that case produced by a slide block 53 which projects from the end flange 52 and engages into a slide groove 54 which is formed at the end face of the coupling plate 51, as is illustrated in FIG. 2.

Furthermore, FIG. 2 shows that the shaft 33 of the second motor 34 extends axially parallel to the shaft 31 of the first motor 32 through the upper region of the upper part 1 of the machine and at a spacing corresponding to the pitch circle radii of the cogwheel means 57 and 58 between this shaft 33 and the second eccentric sleeve 43. Here, too, a support of the shaft is provided by way of a suitable gear bearing 59 and the motor 34 concerned is flanged on the upper end face of the upper part 1 of the machine. The free end of the shaft 33 of the second motor 34 in that case carries a cogwheel 58, which meshes with an outer gear rim 57 at the second, outer eccentric sleeve 43.

As particularly FIG. 2 shows, this drive means is structurally relatively simple by comparison and thereby less expensive, wherein this simple construction assures high precision and operational quietness. Moreover, the control by a common controller of both the motor 32 and 33, which are preferably direct current motors, results in a practically unrestricted variability of the circular rocking movements at the upper die.

It is also possible to re-equip existing machines in accordance with the invention.

Of course, also further possibilities of modification of the above-described wobble-die forging machine exist without having for this purpose to depart from the idea of the invention. Thus, for example, also other motor units can find application. Moreover, each motor can act by way of an intermediate gear on the respective eccentric disc and, furthermore, the coupling means between the first eccentric sleeve and the shaft of the associated motor can be of other construction. Furthermore, the free space in the upper part of the machine, in which the eccentric sleeves as well as the associated coupling and gear means rotate, can bound an oil bath.

What I claim is:

1. A wobble-die forging machine, comprising in combination:

a frame;

a lower die supported on said frame;

a hydraulic cylinder-and-piston system between said frame and said lower die for exerting forging pressure on said lower die in an upward direction;

an upper die disposed above said lower die;

a bell-shaped mounting received in a spheroidal pan on said frame supporting said upper die for wobble movement with respect to a vertical axis;

a guide rod extending upward from said mounting;

a first eccentric sleeve receiving said guide rod, said guide rod being journaled with respect to said first sleeve in a sleeve-aligning bearing;

a second eccentric sleeve journaled on said first eccentric sleeve; and a first motor mounted on said frame directly above said bell-shaped mounting and having a first motor shaft extending along said axis and connected at a lower end thereof with an end of said first sleeve by an axial coupling comprising a horizontally extending coupling plate on said end of said first motor shaft, an upper end flange formed on said end of said first sleeve, said coupling plate and said end flange lying slidably against on another at mutually contacting surfaces and being radially displaceable relative to one another, and a slide block projecting from one of said mutually contacting surfaces into a slide groove formed in the other of said mutually contacting surfaces;

a second motor mounted on said frame and having a second motor shaft parallel to said first motor shaft but horizontally spaced therefrom, said second sleeve being formed with gear teeth and said second motor shaft carrying a gear wheel meshing directly with said teeth; and a common controller for selectively controlling rotational speed and direction to said shafts of said motors.

2. The wobble-die forging machine defined in claim 1 wherein said first and second motor shafts have an interaxial spacing equal to the sum of the pitch radii of said wheel and the teeth on said second sleeve.

3. The wobble-die forging machine defined in claim 1 wherein said frame has an upper part formed with an upper end on which said motors are flanged.

* * * * *